US012623697B2

(12) United States Patent
Schoedl et al.

(10) Patent No.: US 12,623,697 B2
(45) Date of Patent: May 12, 2026

(54) RAILCAR COUPLER KEY RETAINER APPARATUS

(71) Applicant: MINER ENTERPRISES, INC., Geneva, IL (US)

(72) Inventors: Erich A. Schoedl, Sugar Grove, IL (US); Donald E. Wilt, Batavia, IL (US); Bradley J. Haymond, North Aurora, IL (US)

(73) Assignee: Miner Enterprises, Inc., Geneva, IL (US)

( * ) Notice: Subject to any disclaimer, the term of this patent is extended or adjusted under 35 U.S.C. 154(b) by 505 days.

(21) Appl. No.: 18/133,662

(22) Filed: Apr. 12, 2023

(65) Prior Publication Data

US 2023/0347945 A1 Nov. 2, 2023

Related U.S. Application Data

(60) Provisional application No. 63/335,593, filed on Apr. 27, 2022.

(51) Int. Cl.
*B61G 3/06* (2006.01)

(52) U.S. Cl.
CPC ..... *B61G 3/06* (2013.01)

(58) Field of Classification Search
CPC . B61G 1/00; B61G 1/28; B61G 1/283; B61G 1/32; B61G 3/06; B61G 9/00; B61G 9/20
See application file for complete search history.

(56) References Cited

U.S. PATENT DOCUMENTS 3,802,577 A 4/1974 Niggemeler et al.
4,445,617 A 5/1984 Elliott
(Continued)

OTHER PUBLICATIONS

International Searching Authority; Notification of Transmittal of the International Search Report and The Written Opinion of the International Searching Authority; Jul. 5, 2023.
(Continued)

*Primary Examiner* — Robert J McCarry, Jr.
(74) *Attorney, Agent, or Firm* — Law Office of John W. Harbst

(57) ABSTRACT

An apparatus for maintaining a railcar coupler key in position to releasably secure a railcar coupler shank to a yoke accommodated in a sill of a railcar. The railcar coupler key retainer apparatus includes an elongated key stop adapted to be releasably secured against an interior surface of a sill side wall defining an elongated slot. The key stop is configured with a flange portion which projects beyond an exterior surface of the sill side wall defining the slot. The flange portion defines a through bore having a closed margin. A retainer is mounted to the exterior surface of the sill side wall defining the elongated slot and defines a through bore which aligns with the through bore in the flange portion of the key stop when the key stop abuts with a closed end of the elongated slot defined by the side wall of the sill. A locking member is received in the through bores in the key stop and retainer to releasably secure the key stop to the interior surface of the sill side wall and thereby maintaining the railcar key retainer apparatus in position to maintain the railcar coupler key between the side walls of the sill and in position to secure the yoke to the coupler shank.

18 Claims, 2 Drawing Sheets

(56) References Cited

U.S. PATENT DOCUMENTS

| | | | | |
|---|---|---|---|---|
| 2012/0267333 | A1* | 10/2012 | Bomgardner ..... | B61G 9/20<br>213/50.5 |
| 2019/0009802 | A1 | 1/2019 | Anderson et al. | |

OTHER PUBLICATIONS

International Searching Authority; PCT International Search Report; 3 Pages; Jul. 5, 2023.
International Searching Authority;Written Opinion of the International Searching Authority; 6 pages; Jul. 5, 2023.

* cited by examiner

RAILCAR COUPLER KEY RETAINER APPARATUS

RELATED APPLICATION

This patent6 application relates to a co-pending and co-assigned U.S. PROVISIONAL Patent Application, namely, U.S. patent application Ser. No. 63/335,593 filed Apr. 27, 2022; the entirety of which is incorporated herein by reference.

FIELD OF THE INVENTION DISCLOSURE

This invention disclosure is directed to railroad freight cars and, more specifically, to a coupler key retainer apparatus for inhibiting a coupler key from moving out a key slot in a yoke.

BACKGROUND

Two end-to-end railcars are releasably joined to each other by a coupler. A shank portion of the coupler typically extends into a yoke mounted for sliding movements in a housing on a lower portion of the railcar commonly referred to as a sill". The coupler shank portion is secured to the yoke by a coupler key or draft key which extends through aligned key slots in the coupler shank portion and yoke.

The coupler key is prevented from shifting or separating from the yoke with a key retainer assembly. One example of a key retainer assembly used to prevent the coupler key from shifting or separating from the yoke is disclosed in U.S. Pat. No. 8,376,160 assigned to STRATO, Inc. in Piscataway, NJ. The key retainer assembly disclosed in the '160 patent includes a key retainer mounted to an exterior surface on a side wall of the sill in alignment with a key slot defined by the sill side wall. To prevent the coupler key from separating from the yoke, a key stop is arranged in the key retainer. The key stop is maintained in operable association with the key retainer through a pin which fits through aligned openings in the key retainer and key stop.

During violent in-train events or as the railcar travels between distance locations, the car encounters numerous turns and twists. As the car moves between locations, significant lateral forces can be imparted to the coupler key and, ultimately, to the key retainer assembly. With the device in the '160 patent, such forces are exerted onto the exterior surface of sill side wall to which the key retainer is mounted.

Conventional EOC systems also use key retainers for preventing the coupler key from shifting or separating from the yoke. Such conventional EOC systems, however, mount the key retainer on the yoke.

Thus, there is a continuing need and desire for a railcar coupler key retainer apparatus having a simplistic design, enhanced distribution of lateral forces applied thereto, improved visual inspection of the key retainer apparatus coupled with repair of the railcar coupler key retainer apparatus while allowing the coupler to be connected to the yoke and with the yoke remaining in position within the sill of the railcar.

SUMMARY

According to one aspect of this invention disclosure there is provided an apparatus for maintaining a railcar coupler key in position to releasably secure a railcar coupler shank to a yoke accommodated in a sill of a railcar. A side wall of the railcar sill defines an elongated slot which provides access to the railcar coupler key. The railcar coupler key retainer apparatus of this invention disclosure includes a key stop adapted to be releasably secured to an interior surface of the sill side wall surrounding the slot. During railcar operation, the key stop inhibits inadvertent separation of the railcar coupler key from the yoke. The key stop of the railcar key retainer apparatus is furthermore configured such that a flange portion of the key stop projects through the slot to beyond an exterior surface of the side wall of the sill defining the slot. The flange portion of the key stop defines a through bore having a closed margin.

The apparatus for maintaining the railcar coupler key in position further includes a retainer mounted to the exterior surface of the side wall of the sill defining the elongated slot. The retainer defines a through bore which aligns with the through bore in the flange portion of the key stop when the key stop abuts with a closed end of the elongated slot defined by the side wall of the sill. Moreover, the apparatus for maintaining the railcar coupler key in position includes a locking member received in the through bores in the key stop and retainer to releasably secure the key stop relative to the sill side wall whereby maintaining the railcar coupler key in position relative to the coupler shank and the yoke.

In one form, the elongated slot defined by the sill has an open end and a closed end and sides with a predetermined distance between the sides of the slot. An end face on the key stop preferably abuts the closed end of the key slot when the railcar key retainer apparatus is conditioned to maintain the railcar coupler key in position to releasably secure the coupler shank to the yoke.

In a preferred embodiment, the retainer is welded to the exterior surface of the side wall of said sill defining the slot. When passing endwise therethrough, the locking member preferably creates a wedging action between the key stop flange portion and the sill side wall defining the elongated slot. At least a lengthwise portion of the through bore defined by the key stop preferably has a camming surface to facilitate the wedging action as the locking member passes therethrough.

In a preferred embodiment, the locking member includes an elongated pin for maintaining the key stop in position. The locking pin preferably has a configuration between opposed ends thereof which compliments the configuration of the through bore defined by the flange portion on the key stop.

In a preferred form, the apparatus for maintaining the railcar coupler key in position further includes a device arranged in operable connection with a free end of the locking member to inhibit inadvertent separation of the locking member relative to the retainer. Such device preferably includes a cotter pin received in a through hole in a free end of the locking member.

According to another aspect of this invention disclosure a key retainer apparatus is arranged in combination with a railroad car having an elongated sill with first and second laterally spaced and generally parallel side walls, a yoke arranged within the sill, and a railcar coupler shank releasably secured to the yoke through a coupler key. An elongated slot in at least one of the sill side walls provides access to the coupler key. The key retainer apparatus maintains the coupler key between the side walls of the sill in position to releasably secure the coupler shank and yoke to each other. According to this aspect of the invention disclosure, the key retainer apparatus includes a key stop configured to be releasably secured to an interior side of the side wall sill surrounding the slot to block inadvertent separation of the coupler key relative to the yoke. Intermediate opposed ends thereof, the key stop has a flange portion which projects through the slot to beyond an exterior surface of the side wall of the sill defining the elongated slot. The flange portion of the key stop defines a through bore having a closed margin.

According to this aspect of the invention disclosure, a retainer is securely mounted to the exterior surface of the side wall of the sill defining the elongated slot. A through bore in the retainer preferably aligns with the through bore in the flange portion of the key stop when the key stop abuts with a closed end of the elongated slot defined by the side wall of the sill. A pin is accommodated in the through bores in the key stop and retainer to releasably secure the key stop in the elongated slot defined by the sill. The pin is preferably in the form of a wedge which clamps and releasably locks the key stop to the inner surface of the side wall on the sill.

Preferably, the elongated slot in the sill has an open end and a closed end and sides with a predetermined distance between the sides of the slot. In a preferred embodiment, the key stop is configured such that, in one condition, the key stop is clamped to an interior surface of the sill side wall defining the slot. Moreover, in a preferred embodiment, the key stop is configured to abut an end of the railcar key slot when the railcar coupler key is positioned to releasably secure the coupler shank to the yoke.

In a preferred form, the retainer of the apparatus for maintaining the coupler or draft key between the side walls of the sill is welded to the exterior surface of the side wall of the sill defining the elongated slot. In plan, the through bore defined by the retainer has a rectangularly shaped configuration. Preferably, the locking member includes an elongated pin having a wedged configuration between opposed ends thereof to compliment the configuration of the through bore defined by the flange portion of the key stop. When inserted through the through bore in the key stop, the locking member and an exterior side of the sill preferably combine to assert a wedging action between the key stop and the exterior surface of the sill side wall defining the elongated slot.

Preferably, the apparatus for maintaining the coupler key between the side walls of the sill further includes a device arranged in operable connection with a free end of the locking member to inhibit inadvertent separation of the locking member relative to the retainer. In one form, such device comprises a cotter pin received in a through hole in a free end of said locking member of the apparatus.

DETAILED DESCRIPTION

Figure 1:
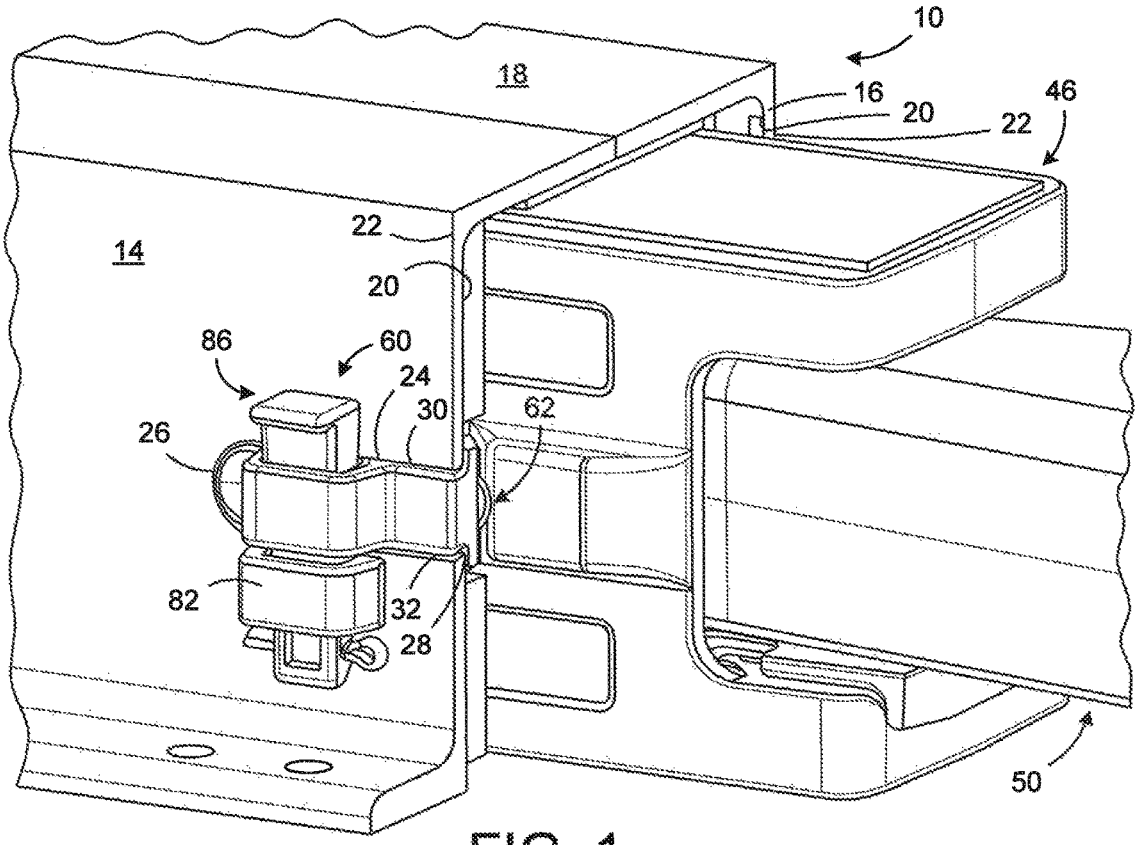
FIG. 1 is a perspective view of the railcar coupler key retainer apparatus according to this invention disclosure.

This disclosure is susceptible of embodiment in railcar freight cars having alternative designs other than that shown in the drawings but will hereinafter be described for use with a railcar having a particular sill. The particular sill design illustrated and described below sets forth an exemplification of one embodiment wherein the present invention finds utility and is set forth with the understanding the invention disclosure hereinafter illustrated and described is not intended to limit the invention disclosure to the specific sill design illustrated and described.

Figure 2:
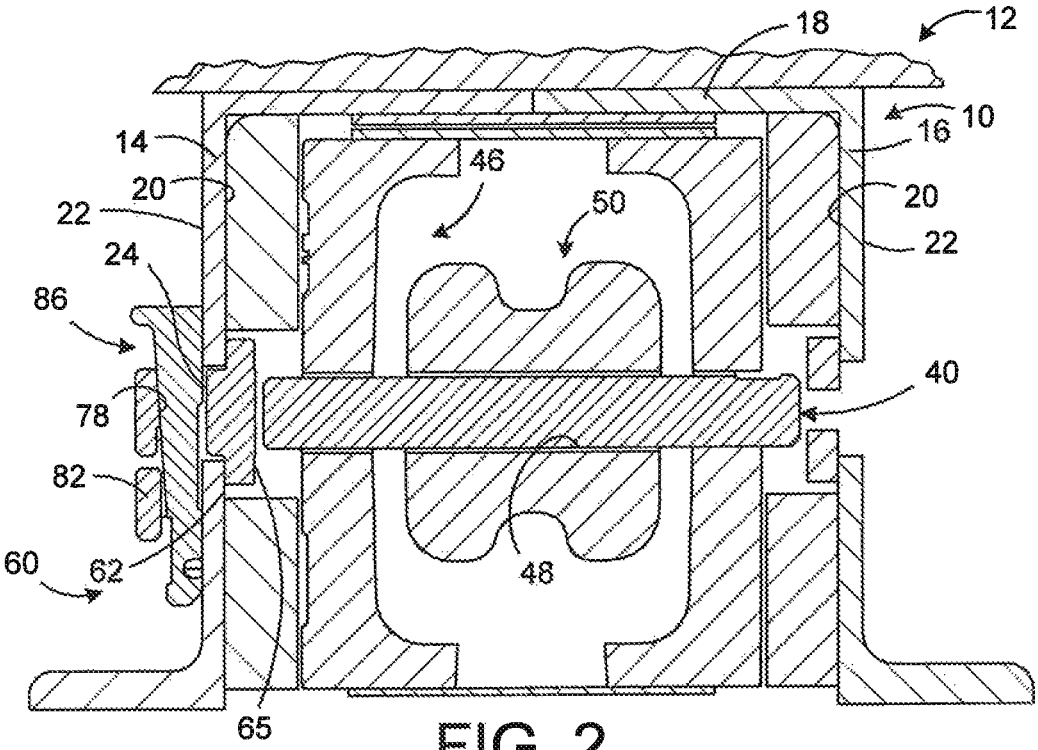
FIG. 2 is a cross-sectional view of the railcar coupler key retainer apparatus shown in FIG. 1.

Referring now to the drawings wherein like reference numerals indicate like parts throughout the several views, there is shown in FIG. 1 a conventional railcar sill 10. As is well known in the art, the sill 10 is mounted to an underside of a railcar 12 (FIG. 2). In the illustrated embodiment, the sill 10 includes two laterally spaced and generally parallel side walls 14 and 16 which are joined by a top wall 18. It should be understood and appreciated, however, other embodiments of sill 10 are equally applicable without detracting or departing from the spirit and scope of this invention disclosure. Suffice it to say, each side wall 14, 16 of sill 10 has an interior surface 20 and an exterior surface 22.

In the embodiment illustrated in FIG. 2, each sill side wall 14, 16 defines an elongated slot or cutout 24 which beneficially permits access to a railcar coupler key or draft key 40 arranged between the side walls 14 and 16 of sill 10. In the embodiment illustrated in FIG. 1, the elongated slot or cut out 24 has a closed end 26 longitudinally spaced from an opposite end 28. In the embodiment illustrated for exemplary purposes, the end 28 of slot 26 is open. Moreover, each slot 24 has generally parallel upper and lower edges 30 and 32 which extend the length of the slot 24. As illustrated in FIG. 2, each slot 24 opens to both the interior and exterior surfaces 20 and 22, respectively, of each respective side wall.

As is known, the coupler key or draft key 40 is accommodated in a yoke 46 which slides in a fore-and-aft direction in the sill 10. The draft key 40 is arranged horizontally, typical of an E-type coupler. More specifically, the key coupler or draft key 40 for an E-type coupler is a generally flat horizontally arranged element, longer than it is wide and wider than it is thick and is accommodated in a key slot 48 defined by the yoke 40. The coupler key or draft key 40 serves to attach a coupler shank 50 to the yoke 40. As is known, the yoke 40 is preferably configured to accommodate a cushioning unit (not shown) in combination with the yoke 40. Moreover, the yoke 40 is preferably provided with a suitable surface against which the cushioning unit can bear in a shock absorbing manner when a buff force is applied to the coupler.

According to the present invention disclosure, a railcar coupler key retainer apparatus, generally indicated by reference numeral 60, is provided in combination with the sill 10 for retaining the coupler key or draft key 40 in position to releasably secure the yoke 46 and railcar coupler shank portion 50 to each other and within the yoke 46. The railcar coupler key retainer apparatus 60 includes a key stop 62 configured to physically retain the draft key 40 from separating from the yoke 46 and coupler shank 50 when the coupler key retainer apparatus 60 in a first or closed condition while allowing the key retainer apparatus 60 to move to a second or open position whereby providing access to the draft key 40.

Figure 3:
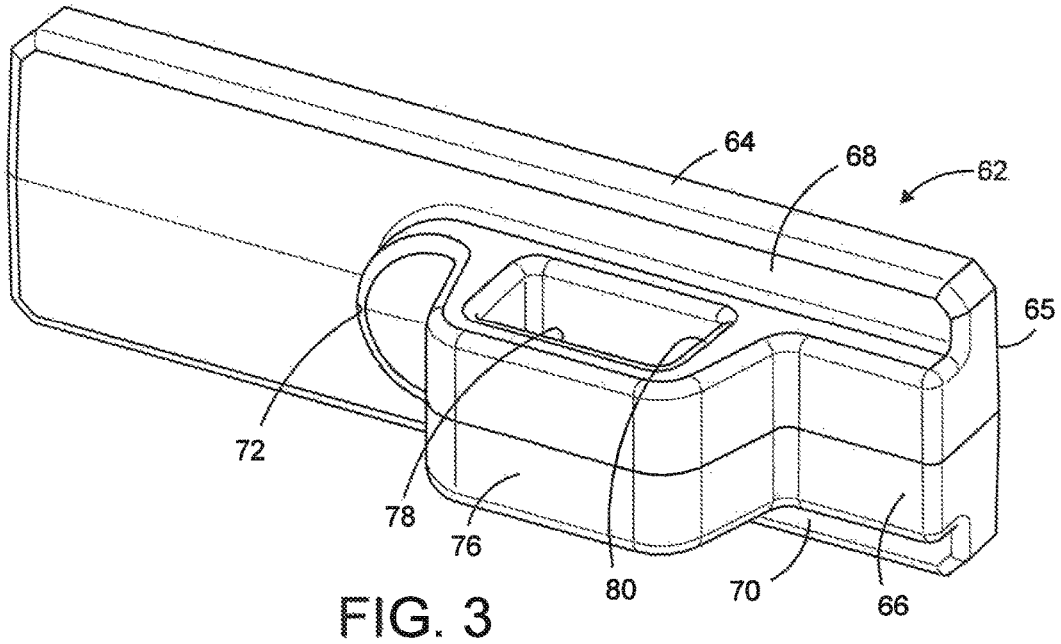
FIG. 3 is a perspective view of a key stop forming part of the railcar coupler key retainer apparatus shown in FIG. 1.

Turning to FIG. 3, the key stop 62 preferably has an elongated shape and includes an enlarged head portion 64 defining an interior and planar surface 65 and a shank portion 66. Suffice it to say, the elongated shape of the key stop 62 is sized to substantially close the slot 24 when the coupler key retainer apparatus 60 is in a locked condition whereby retaining the draft key 40 in position to releasably secure the yoke 46 and railcar coupler shank portion 50 to each other and within the sill 10. As depicted in FIG. 2, with the coupler key retainer apparatus in the first or closed condition, the draft key 40 advantageously abuts directly against the interior planar surface 65 on the key stop 62 and between the sill side walls 14, 16.

Figure 4:
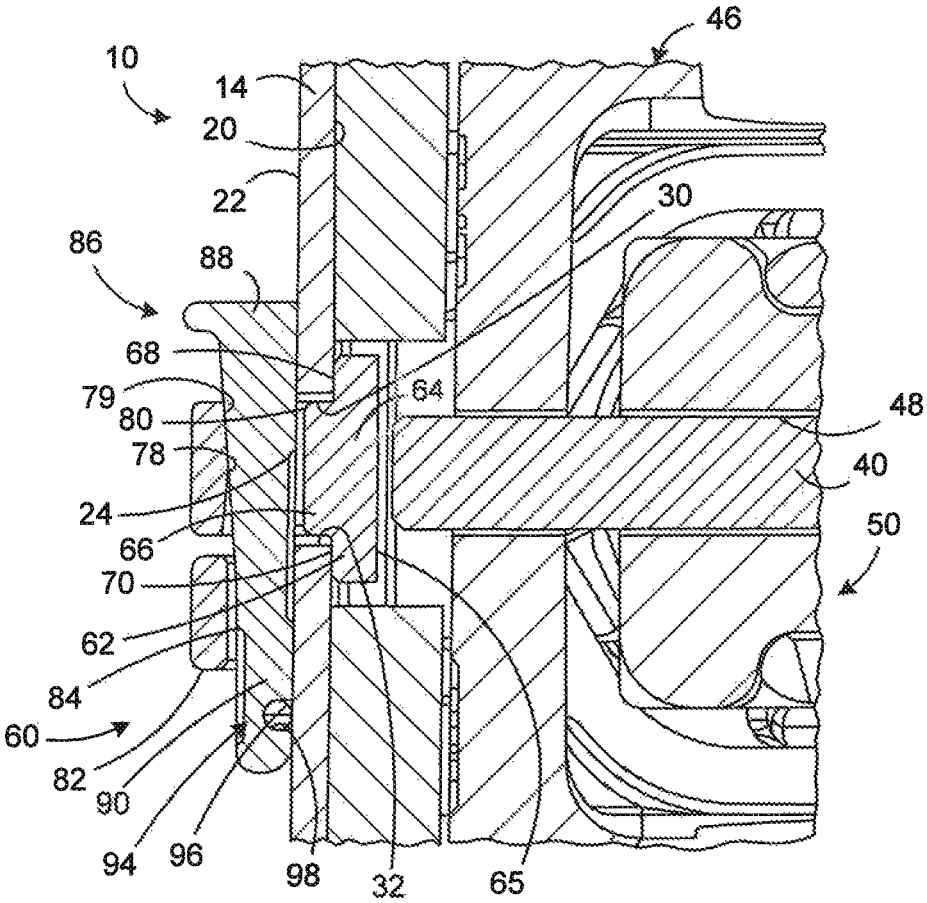
FIG. 4 is an enlarged section view similar to FIG. 2.

In the embodiment shown in FIG. 4, the head portion 64 of the key stop 62 is sized larger or wider than the shank portion 66 and is wider than the distance separating the edges 30 and 32 of the elongated slot 24. As such, and at the juncture of the first portion 64 and second portion 66, the key stop 62 defines a pair of preferably like shoulders 68 and 70. When the key stop 62 is arranged in an unlocked condition, the shoulders 68, 70 guide the key stop 62 to slide along the interior surface 20 of the sill side wall 14 surrounding the elongated slot 24.

When arranged in operable combination with the sill 10, the shank or second portion 66 of the key stop 62 projects through the elongated slot 24 in the sill side wall 14. Moreover, and when the coupler key retainer apparatus 60 is in a locked condition, the key stop 62 is preferably configured such that a terminal edge 72 on the second portion 66 of the key stop 62 abuts with the closed end 26 (FIG. 1) of the elongated slot or cutout 24 in the sill side wall 14.

Returning to FIG. 3, the key stop 62 is provided, intermediate the opposed ends thereof, with a flange projection 76 which is secured to and projects from the second portion 66 of the key stop 62 to beyond the exterior surface 22 of the sill side wall 14. The flange portion 76 defines a vertical through bore 78 which, in one form, has a closed margin 80. In one embodiment, the closed margin 80 of the through bore 78 has a generally rectangular configuration, in plan, between the open ends thereof. As shown in FIG. 4, and in one form, when the key stop 62 is arranged in operable combination with the sill 10, a portion of the marginal edge 80 of the through bore 78 is preferably disposed laterally inward from and relative to the exterior surface 22 of the sill side wall 14.

As illustrated in FIGS. 2 and 4, and to retain the coupler key retainer apparatus 60 in a releasably locked condition relative to the elongated slot or cut out 24 defined in the sill side wall 14, apparatus 60 further includes a retainer 82 secured, as by any suitable means known in the art, i.e. welding, suitable fasteners, etc. to the exterior surface 22 of side wall 14. The retainer 82 defines a through bore 84. When the retainer 82 is secured to the exterior of the sill side wall 14, and the terminal edge 72 of the second portion 66 of the key stop 62 abuts with the closed end 26 of the elongated slot or cut out 24, the through bore 84 in the retainer 82 is disposed in alignment with and beneath the through bore 78 in the flange portion 76 of the key stop 52. In one form, the through bore 84 defined by retainer 82 has a generally rectangular cross-sectional configuration, in plan, between the open ends thereof.

When the coupler key retainer apparatus 60 is in a locked condition, with the terminal edge 72 of the key stop 62 abutting the closed end 26 of the sill cut out 24, an elongated locking pin 86 is received in and is designed to pass endwise through the aligned through bore 78 in the key stop 62 and the through bore 84 in the retainer 82. As will be appreciated, and with apparatus 60 in the locked condition, the locking pin 86 serves to inhibit longitudinal shifting movements of the key stop 62 within the elongated slot or cut out 24.

More specifically, in a preferred embodiment, the locking pin 86 is in the form of a wedge which cooperates with the through bore 78 in the flange portion 76 of the key stop 52 and the through bore 84 in the retainer 82 to clamp and releasably lock and hold the key stop 62 in a locked condition relative to the sill 10. In the embodiment illustrated for exemplary purposes, the locking pin 86 includes an enlarged head portion 88 and an elongated shank portion 90. The shank portion 90 of pin 86 preferably has a generally rectangular cross-sectional configuration which complements the cross-sectional and marginal configurations of the through bore 78 in the key stop 62 and the through hole 84 in the retainer 82. More specifically, and as depicted in FIG. 4, the shank portion of pin 86 preferably has a tapered configuration between the head portion 88 and the terminal free end of pin 86. As a complement thereto, and between opposed ends thereof, the through bore 78 in the flange portion 76 of the key stop 62 is preferably configured with a suitable camming surface 79 to facilitate the wedging action between the locking pin 86 and sill 10 as pin 86 passes through the through bores 78 and 84 in the key retaining apparatus 60. In a preferred form, the camming surface 79 on the marginal edge of the through bore 78 coupled with configuring the laterally inward portion of the marginal edge 80 of the through bore 78 to be disposed laterally inward from and relative to the exterior surface 22 of the sill side wall 14 enhances the wedging action of the locking pin 86 and serves to facilitate clamping, releasably locking and holding the key stop 62 in a locked condition relative to the sill 10.

As the pin 86 passes through the through bore 76 in the key stop 62, the pin 86 operably cooperates with the camming surface 79 on the closed margin 80 of the key stop 62 along with the exterior surface 22 of the sill side wall 14. As such, the shoulders 68 and 70 of the key stop 62 are drawn, pressed and ultimately secured against the interior surface 20 of the sill side wall 14 surrounding the elongated slot 24 whereby releasably locking the key stop 62 against the sill side wall and relative to the elongated slot 24.

The design of the present invention disclosure furthermore allows a quick and ready change of the key retainer apparatus 60 from a locked condition to an unlocked condition. In the unlocked condition of the key retainer apparatus 60, access to the coupler or draft key 40 (FIG. 2) used to releasably secure the yoke 46 to the coupler shank portion 50 can be achieved. That is, simply by manually removing the pin 86 from bore 78 in the key stop 62 and the bore 84 in the retainer 82, the key stop 62 can be moved from its association with the sill side wall 14 whereby permitting unobstructed access to the draft key 40.

In a preferred embodiment, the key retainer apparatus 60 furthermore includes structure 94 for inhibiting an inadvertent change in the condition of the key retainer apparatus 60 from the locked condition to the unlocked condition. In one form, and toward a distal end thereof, the shank portion 90 of the locking pin 86 defines a bore or opening 96. Suffice to say, the bore or opening 96 is defined by the locking pin 86 is such that the bore or opening 96 is disposed beneath a lowermost surface on the retainer 82 when the key retainer apparatus 60 is in a locked condition with the pin 86 passing through both the through hole 78 in the key stop 62 and the through hole 84 in the retainer 82. In the embodiment shown, and with when the key retainer apparatus 60 is in a locked condition, a cotter pin 98 is used to secure the pin 86 in place and thereby keep the key stop 62 in place.

Unlike known coupler key retainer systems, the key stop 62 of the key retainer apparatus 60 advantageously shifts the abusive lateral forces inevitably acting on the draft key 40, resulting from turns and in-service operation of the railcar 10, directly to the interior surface 20 of the sill side wall 14. The key retainer apparatus 60 furthermore serves to retain the draft key 40 in operable combination with the yoke 46 and coupler shank portion 50. As will be appreciated by those skilled in the art, the retainer 82 for the key retainer apparatus 60 can be located and suitably secured to the outer surface 22 of the sill side wall 14 as required. Moreover, the preferred design of this invention disclosure advantageously lends itself to the application of a wedging action to be applied to the key stop 62 and related parts so as to releasably and beneficially hold the key retainer apparatus 60 in a tight clamped relation to the sill 10 as the railcar 12 moves between locations.

From the foregoing, it will be observed numerous modifications and variations can be made and effected to the coupler key retainer apparatus and sill without departing or detracting from the true spirit and novel concept of this invention disclosure. Moreover, it will be appreciated this invention disclosure merely sets forth an exemplification of the invention disclosure and is not intended to limit or otherwise restrict the invention disclosure to the specific embodiment illustrated. Rather, this invention disclosure is intended to cover by the appended claims all such modifications and variations as fall within the spirit and scope of the appended claims.

What is claimed is:

1. An apparatus for maintaining a railcar coupler key in position to releasably secure a railcar coupler shank to a yoke accommodated in a sill of a railcar, said apparatus comprising:

a key stop configured to be releasably secured against an interior surface of a sill side wall surrounding an elongated slot to inhibit inadvertent separation of the coupler key from the yoke;

and with said key stop further including a flange portion projecting through said slot to beyond an exterior surface of the side wall of said sill defining said slot, with said flange portion defining a through bore having a closed margin;

a retainer mounted to the exterior surface of the side wall of said sill defining said slot, with said retainer defining a through bore which aligns with the through bore in the flange portion of the key stop when the key stop abuts with a closed end of the elongated slot defined by the side wall of said sill; and a locking member received in said through bores in said key stop and said retainer to releasably secure the key stop to the sill.

2. The apparatus according to claim 1, wherein the elongated slot has a open end and a closed end and sides with a predetermined distance between said sides.

3. The apparatus according to claim 1, wherein substantially an entire facing surface on said key stop is disposed to abut an end of the coupler key when said retainer apparatus is conditioned to releasably secure the coupler shank to said yoke.

4. The apparatus according to claim 1, wherein said retainer is welded to the exterior surface of the side wall of said sill defining said slot.

5. The apparatus according to claim 1, wherein a margin of said through bore defined by said retainer has a camming surface configured to facilitate securement of said key stop to the interior surface of the sill side wall surrounding said slot.

6. The apparatus according to claim 1, wherein said locking member includes an elongated pin, with said elongated pin being configured between opposed ends to compliment the marginal configuration of the through bore defined by said retainer such that said locking member and an exterior side of said sill combine to assert a wedging action to said apparatus as said locking member is inserted into the through bore in said key stop.

7. The apparatus according to claim 1, further including a device arranged in operable connection with a free end of said locking member so as to inhibit inadvertent separation of said locking member relative to said retainer.

8. The apparatus according to claim 7, wherein said device comprises a cotter pin received in a through hole in a free end of said locking member.

9. In combination with a railroad car having an elongated sill with first and second laterally spaced and generally parallel side walls, with at least one side wall of said sill defining an elongated slot, a yoke arranged within said sill, and a railcar coupler shank releasably secured to said yoke through a coupler key, an apparatus for maintaining said coupler key between said side walls of said sill in position to releasably secure said coupler shank and said yoke to each other, said apparatus comprising:

a key stop configured to be releasably secured relative to an interior surface surrounding the elongated slot defined by said side wall on the sill of said railcar, with said slot providing access to said coupler key when said apparatus is in an unlocked condition;

and with said key stop including, intermediate the ends thereof, a flange portion projecting through said slot to beyond an exterior surface of the side wall of said sill defining said slot, with said flange portion defining a through bore having a closed margin;

a retainer mounted to the exterior surface of the side wall of said sill defining said slot, with said retainer defining a through bore which aligns with the through bore in the flange portion of the key stop when said retainer apparatus is in a locked condition with said key stop abutting with a closed end of the elongated slot defined by the side wall of said sill; and a pin accommodated in said through bores in said key stop and said retainer to releasably secure the key stop in the elongated slot defined by the sill.

10. The railroad car according to claim 9, wherein the elongated slot in said sill has an open end and a closed end and a marginal edge having sides with a predetermined distance between said sides.

11. The railroad car according to claim 9, wherein substantially an entire interior facing surface on the key stop of said apparatus is disposed to abut an end of the coupler key when said retainer apparatus is in the locked condition.

12. The railroad car according to claim 9, wherein the retainer of said apparatus is welded to the exterior surface of the side wall of said sill defining said slot.

13. The railroad car according to claim 9, wherein the through bore defined by the key stop of said apparatus has a surface for facilitating securement of said key stop to the interior surface of the sill surrounding said elongated slot.

14. The railroad car according to claim 13, wherein said locking member includes an elongated pin, with said elongated pin being configured between opposed ends to compliment the marginal configuration of the through bore defined by the flange portion of said key stop such that said locking member and an exterior side of said sill combine to allow said apparatus to exert a wedging action, therebetween as said locking member is inserted through the through bore in the flange portion of said key stop.

15. The railroad car according to claim 9, further including a device arranged in operable connection with the locking member of said apparatus so as to inhibit inadvertent separation of said locking member relative to said retainer.

16. The railroad car according to claim 15, wherein said device comprises a cotter pin received in a through hole in a free end of said locking member of said apparatus.

17. The railroad car according to claim 9, wherein the coupler key has a generally rectangular top plan view.

18. A method for retaining a railcar coupler key in position between parallel side walls of a railcar sill, with at least one of the side walls of said sill defining an opening for allowing said coupler key to be positioned between said side walls of said sill and into operable combination with a shank of a railcar coupler shank, comprising the steps of:

arranging a key stop between the side walls of said sill and in position to inhibit said coupler key from inadvertently passing from between the side walls of said sill; and clamping said key stop to said sill and in position to inhibit said coupler key from inadvertently passing from between the side walls of said sill.

* * * * *